US005433136A

United States Patent [19]

Lung-Po

[11] Patent Number: 5,433,136

[45] Date of Patent: Jul. 18, 1995

[54] HAND PUMP WITH HANDLE STORAGE COMPARTMENT

[75] Inventor: Tsai Lung-Po, Taipei Hsien, Taiwan

[73] Assignee: Ho Lee Co., Ltd., Tamshui Taipei, Taiwan

[21] Appl. No.: 254,826

[22] Filed: Jun. 6, 1994

[51] Int. Cl.[6] ..... F01B 31/00

[52] U.S. Cl. ..... 92/58.1; 92/128; 417/234

[58] Field of Search ..... 417/544, 234 X; 92/58.1, 128

[56] References Cited

U.S. PATENT DOCUMENTS 785,154 3/1905 Cordeau ..... 92/58.1
2,557,139 6/1951 Peters et al. ..... 92/58.1

FOREIGN PATENT DOCUMENTS 173157 5/1952 Germany ..... 92/58.1
236906 7/1945 Switzerland ..... 92/58.1

*Primary Examiner*—Thomas E. Denion
*Attorney, Agent, or Firm*—Lowe, Price, LeBlanc & Becker

[57] ABSTRACT

A hand pump including a cylindrical pump body having an embossed outside surface for the holding of the hand, a cap fastened to the pump body at the top through a screw joint and having a unitary hanger for hanging things, a piston rod inserted through a hole on the cap and having a piston handle disposed outside the pump body and driven to reciprocate the piston rod in pumping air out of the pump body into the inflatable object to be inflated, the piston handle defining a storage chamber releasably sealed by a plug cap for keeping accessories.

1 Claim, 3 Drawing Sheets

HAND PUMP WITH HANDLE STORAGE COMPARTMENT

BACKGROUND OF THE INVENTION

The present invention relates to a hand pump which has a storage chamber on the piston handle thereof for keeping accessories.

Various hand pumps have been disclosed for pumping air into bicycle tires or inflatable objects. FIG. 1 shows a hand pump according to the prior art, which comprises a cylindrical pump body 10' having an air outlet 11' at the bottom and a cap 12' at the top, a piston rod 13' inserted through the cap 12' into the pump body 10', and a piston handle 14' coupled to the piston rod 13' and moved to reciprocate the piston rod 13' in pumping air out of the air outlet 11'. This structure of hand pump has drawbacks. Because the pump body 10' has a smooth outside surface, it may slip when it is held in the hand during the pumping. Another drawback of this structure of hand pump is that the connection between the cap 12' and the pump body 10' may be damaged easily as the piston rod 13' is reciprocated because the cap 12' is fastened to the pump body 10' through a ultrasonic sealing process. Furthermore, when in use, a valve needle 17' or an air hose 15' with a connector 16' may be used for connecting the object to-be inflated to the air outlet 11' of the pump body 10'. However, it is not convenient to carry these accessories. If these accessories are not properly kept, they may be lost easily.

SUMMARY OF THE INVENTION

The present invention has been accomplished to provide a hand pump which eliminates the aforesaid drawbacks. According to one aspect of the present invention, the pump body has an embossed outside surface so that is can be firmly held in the hand during the operation of the hand pump. According to another aspect of the present invention, the cap is fastened to the pump body through a screw joint so that the cap does not displace when the piston rod is reciprocated. According to still another aspect of the present invention, the cap of the pump body has a unitary hanger for hanging the air hose. According to still another aspect of the present invention, the piston handle defines a storage chamber releasably sealed by a plug cap for keeping the valve needle and the connector.

DETAILED DESCRIPTION OF THE PREFERRED EMBODIMENT

Figure 1:
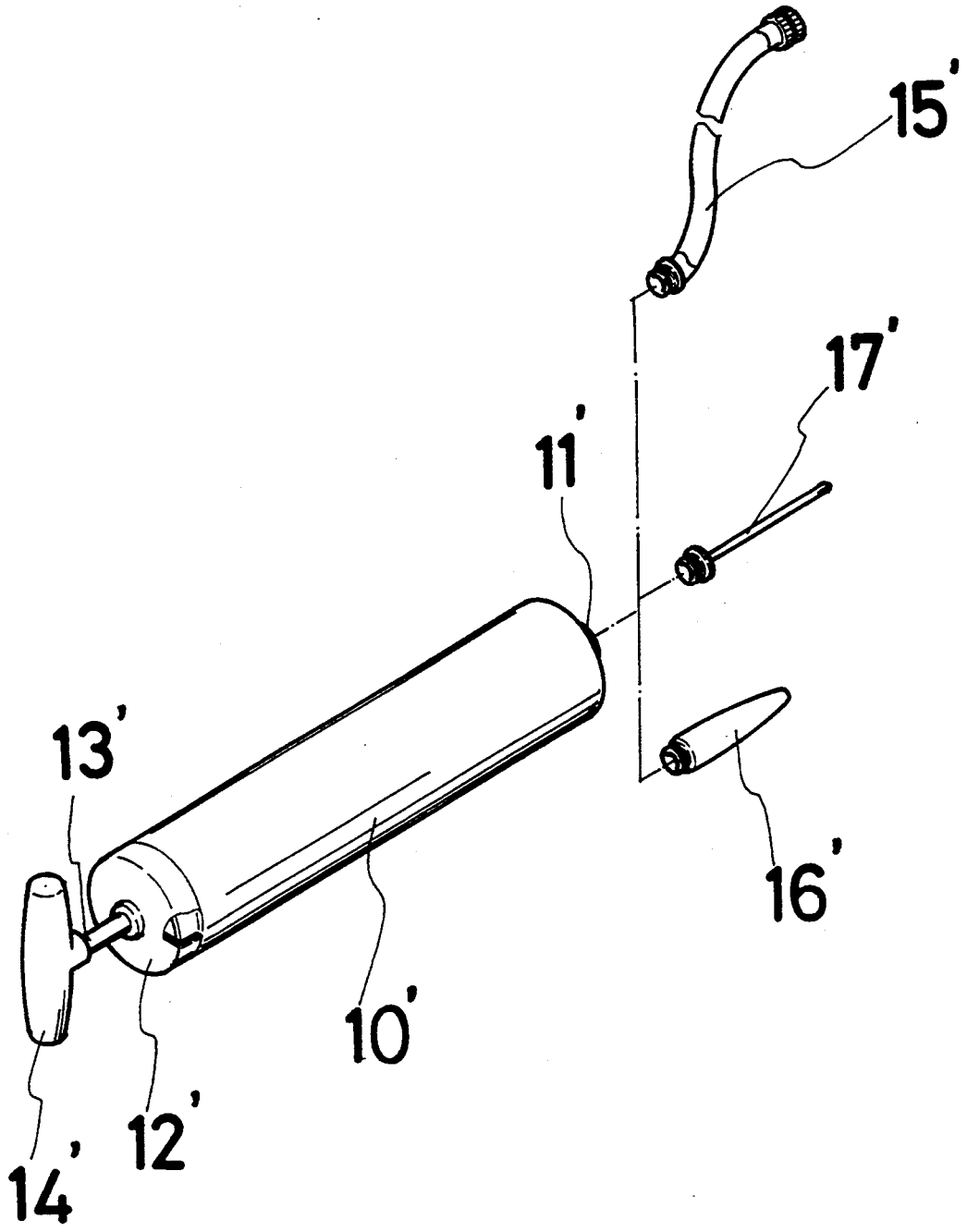
FIG.1 (PRIOR ART)
FIG. 1 shows a hand pump according to the prior art.
Figure 2:
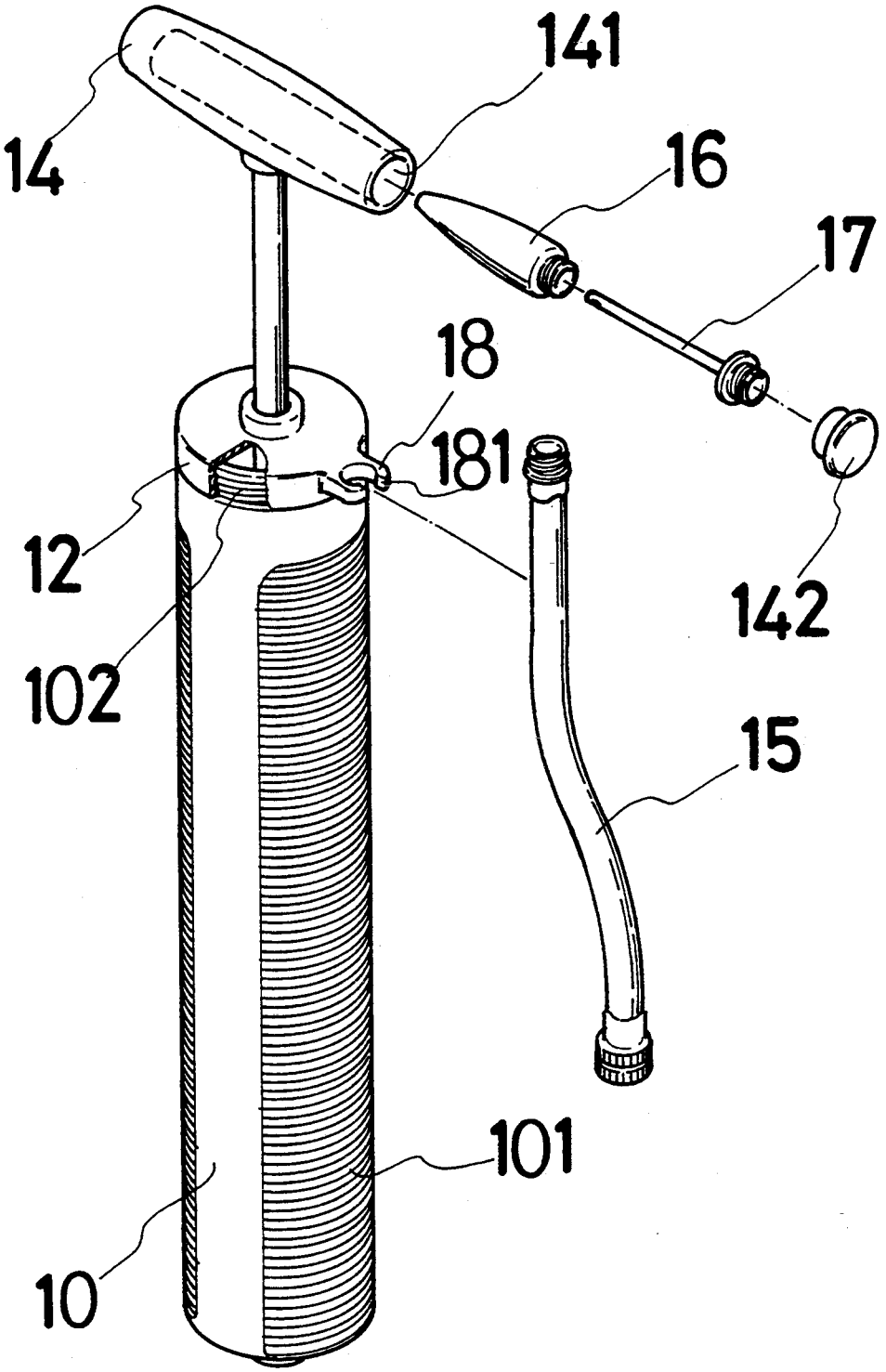
FIG. 2 shows a hand pump according to the present invention.
Figure 3:
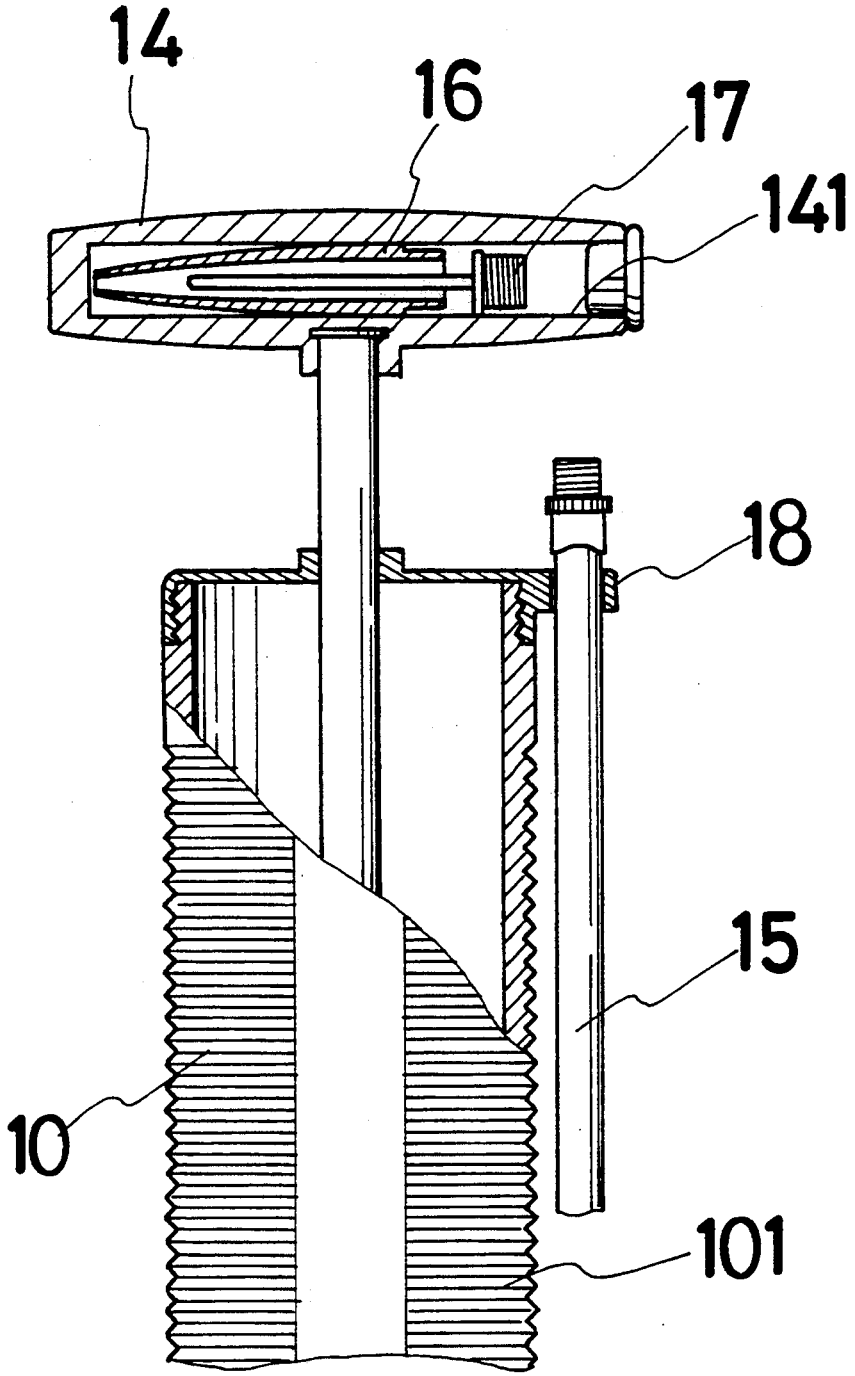
FIG. 3 is a sectional view in an enlarged scale of the hand pump shown in FIG. 2, showing the connector and the valve needle received inside the storage chamber of the piston handle and the air hose hung on the hanger.

Referring to FIGS. 2 and 3, the hand pump comprises a cylindrical pump body 10 having an embossed outside surface 101 for the holding of the hand positively and an outer thread 102 around a top end thereof, an internally threaded cap 12 fastened to the outer thread 102 of the pump body 10 through a screw joint and having a unitary hanger 18 defining an open hole 181 for hanging things, and a piston handle 14 connected to the piston thereof at the top and having a storage chamber 141 sealed by a plug cap 142.

When in use, a valve needle 17 may be directly fastened to the air outlet (not shown) on the pump body 10 for letting air be driven into a ball or inflatable item. Alternatively, an air hose 15 may be provided having one end coupled to the air outlet on the pump body 10 and an opposite end coupled with a connector 16 for fastening to the inflatable object to be inflated. When not in use, the air hose 15 can be hung on the hanger 18. The connector 16 and the valve needle 17 can be received inside the storage chamber 141 of the piston handle 14.

As indicated, the present invention achieves various advantages. One advantage of the present invention is that thee cap does not displace when the piston handle 14 is reciprocated because the cap 12 is fastened to the pump body 10 through a screw joint. Another advantage of the present invention is that the connector 16 and valve needle 17 can be received inside the storage chamber 141 of the piston handle 14 when they are not in use. Still another advantage of the present invention is that the pump body 10 has an embossed outside surface 101 so that it can be firmly held in the hand during the air pumping operation.

What is claimed is:

1. A hand pump comprising a cylindrical pump body having an air inlet and an air outlet, a cap fastened to said pump body at the top, a piston rod inserted through a hole on said cap, a hollow piston handle mounted at one end of said rod disposed outside said pump body and a piston body at an opposite end disposed inside said pump body, said piston being reciprocated by said piston handle to pump air out of the air outlet, said pump body having an embossed outside surface for holding by hand; said cap being threadedly fastened to said pump body and having a hanger attached thereto; said piston handle having a cylindrical outer wall to define an accessory storage chamber therein, said handle having an access port at an end thereof, the end of said rod being attached to said handle at the center of the outer wall thereof, and a plug cap removably received in said port.

* * * * *